US005099617A

United States Patent [19]

Bovone

[11] Patent Number: 5,099,617

[45] Date of Patent: Mar. 31, 1992

[54] METHOD AND APPARATUS FOR BEVELLING INTERIOR ANGLES OF SHEETS OF COLORED OR NON-COLORED PLAIN GLASS, PLATE GLASS OR FLATTENED GLASS, AND THE PRODUCT OBTAINED

[76] Inventor: Luigi Bovone, Via Pernigotti, 19, 15070 Belforte Monferrato, Italy

[21] Appl. No.: 493,980

[22] Filed: Mar. 15, 1990

[30] Foreign Application Priority Data

Apr. 19, 1989 [IT] Italy ..... 20196 A/89

[51] Int. Cl.[5] ..... B24B 1/00

[52] U.S. Cl. ..... 51/283 E; 51/98 R; 51/99; 51/125

[58] Field of Search ..... 51/283 E, 98 R, 99, 51/283 R, 125, 126, 131.3

[56] References Cited

U.S. PATENT DOCUMENTS 4,905,425 3/1990 Sekigawa et al. ..... 51/283 E

*Primary Examiner*—M. Rachuba
*Attorney, Agent, or Firm*—Steinberg & Raskin

[57] ABSTRACT

A method and apparatus for bevelling interior angles of sheets of colored or non-colored plain glass, plate glass or flattened glass, is disclosed. The vertex of the interior angles is bevelled, with assigned rake and bevel angles of the rotary tool, by moving the tool parallel to the bisector of said angle, first on one side and then on the other side of the bisector, with the active part of the tool substantially tangential to the bisector. The apparatus comprises at least one rotary tool such as a grinding wheel, drive means for rotating the tool, a first member for supporting the tool and a rotary assembly or the like to enable them to be moved angularly within a first vertical plane about a diameter of the tool. A second member supports the first member in such a manner as to enable them to be moved angularly within a second vertical plane perpendicular to the first vertical plane. The second member is supported in such a manner as to enable the tool to be moved in three mutually perpendicular directions and rotated about one of the directions. A sheet of colored or non-colored plain glass, plate glass or flattened glass with at least one bevelled interior angle is produced.

7 Claims, 5 Drawing Sheets

METHOD AND APPARATUS FOR BEVELLING INTERIOR ANGLES OF SHEETS OF COLORED OR NON-COLORED PLAIN GLASS, PLATE GLASS OR FLATTENED GLASS, AND THE PRODUCT OBTAINED

BACKGROUND OF THE INVENTION

This invention relates to a method and apparatus for bevelling angles of sheets of plain glass, plate glass or flattened glass.

The invention also relates to the product obtained.

In bevelling glass sheets it is known to use rotary tools (such as grinding wheels and buffers) mounted on more or less complex production equipment. Bevelling is carried out on either straight or curved sides of the sheets.

There is however as yet no satisfactory method for bevelling so-called interior angles, i.e. when the angle between two adjacent edges of the sheet opens outwards from the sheet. Examples of such interior angles are shown in FIGS. 1, 2 and 3 of the accompanying drawings. Specifically, FIG. 1 is a partial perspective view of a sheet L with a bevel 102, this sheet having an interior angle AI opening outwards from the sheet and having its vertex indicated by XA.

FIG. 2 is a plan view of a shaped sheet LA bevelled at 102A and having two interior angles AIA which open outwards. FIG. 3 is a plan view of a differently shaped glass sheet bevelled at 102B and having two interior angles AIB.

In these types of sheet the problem to be solved is to adequately finish the vertex XA of the interior angle without fracturing or chipping. This problem is currently solved by final touching-up operations carried out by highly specialized craftsmen who generally work with special instruments.

OBJECTS AND SUMMARY OF THE INVENTION

An object of the present invention is to provide a method for bevelling interior angles of sheets of coloured or non-coloured plain glass, flattened glass or plate glass using motorized rotary tools, by which the resultant vertices of the interior angles satisfy commercial requirements.

A further object of the present invention is to provide a method for bevelling interior angles of sheets of coloured or non-coloured plain glass, flattened glass or plate glass which is suitable for implementation by an automatic or semi-automatic machine or apparatus.

A further object of the present invention is to provide an at least partly peripherally bevelled sheet of coloured or non-coloured plain glass, flattened glass or plate glass which has at least one interior angle bevelled.

These and further objects which will be more apparent from the detailed description given hereinafter are attained according to the invention by a method characterised essentially in that the vertex of an interior angle of a sheet of plain glass, flattened glass or plate glass is bevelled, with suitable rake and bevel angles of a rotary tool, by moving the tool parallel to the bisector of said angle, firstly on one side and then on the other side of the bisector, with the active part of said tool lying substantially on said bisector.

The term "bisector" used herein indicates not a pure and simple straight line as in the case of flat angles, but a plane which bisects the interior angle, which is itself a dihedron, i.e. an angle between two planes.

BRIEF DESCRIPTION OF THE DRAWINGS

The invention will be more apparent from the detailed description of a preferred embodiment thereof given hereinafter by way of non-limiting example with reference to the accompanying drawing, in which.

DETAILED DESCRIPTION

Figure 1:
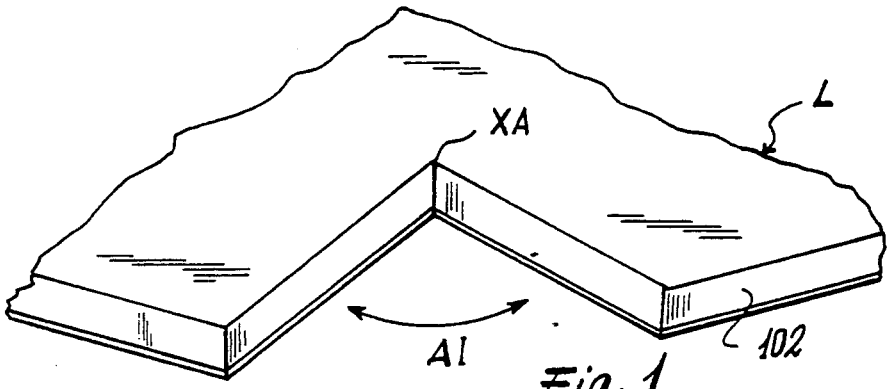
FIG. 1 is a partial perspective view of a bevelled sheet.
Figure 2:
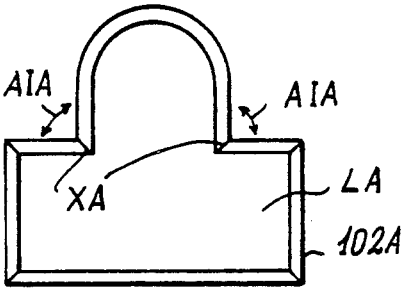
FIG. 2 is a plan view of a shaped sheet of the prior art.
Figure 3:
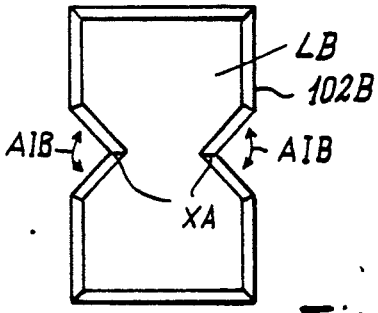
FIG. 3 is a plan view of a differently shaped glass sheet of the prior art.
Figure 4:
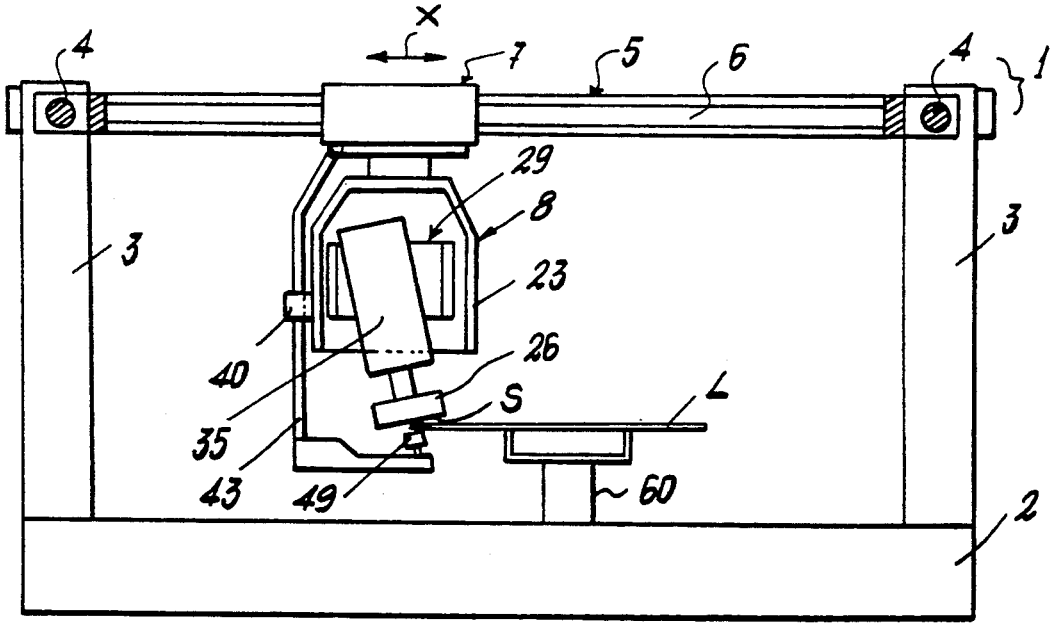
FIG. 4 is a schematic overall front view of the apparatus according to the invention.
Figure 5:
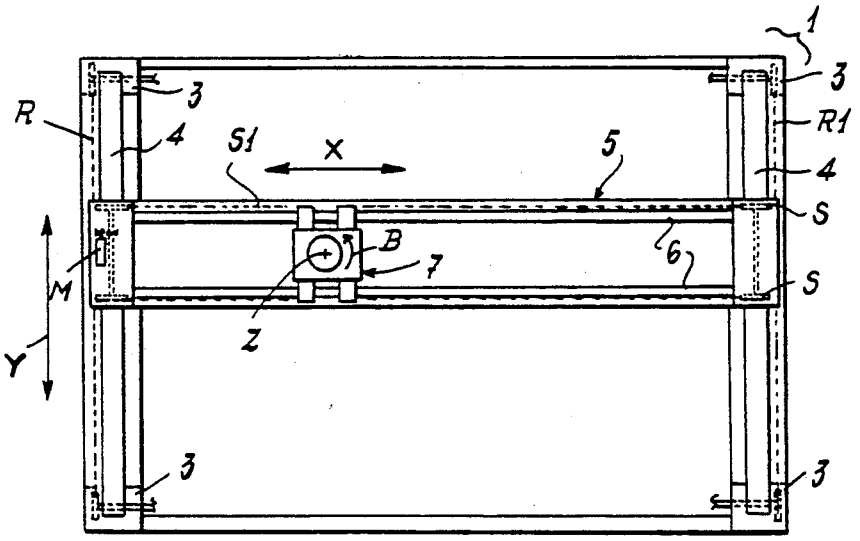
FIG. 5 is a schematic plan view thereof.
Figure 6:
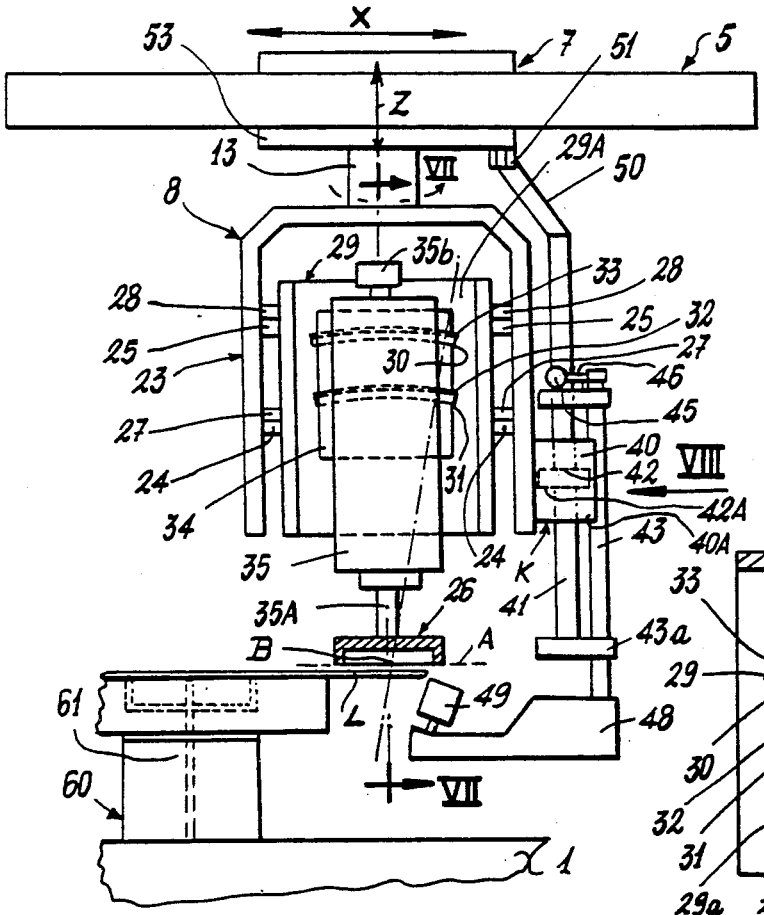
FIG. 6 is a schematic detailed side view of the operating head of the apparatus.
Figure 7:
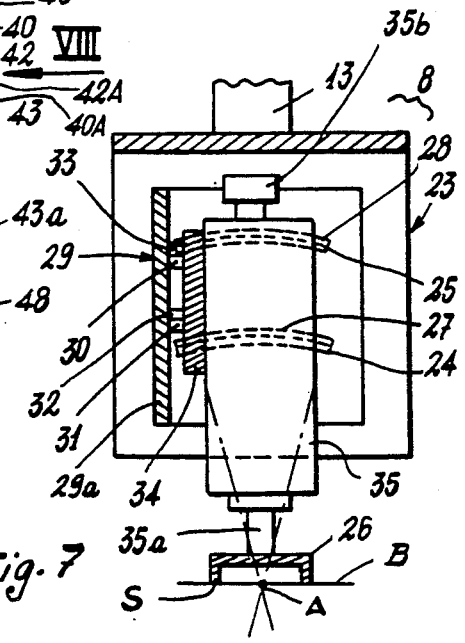
FIG. 7 is a schematic section on the line VII—VII of FIG. 6, with some parts omitted for simplicity of representation.
Figure 8:
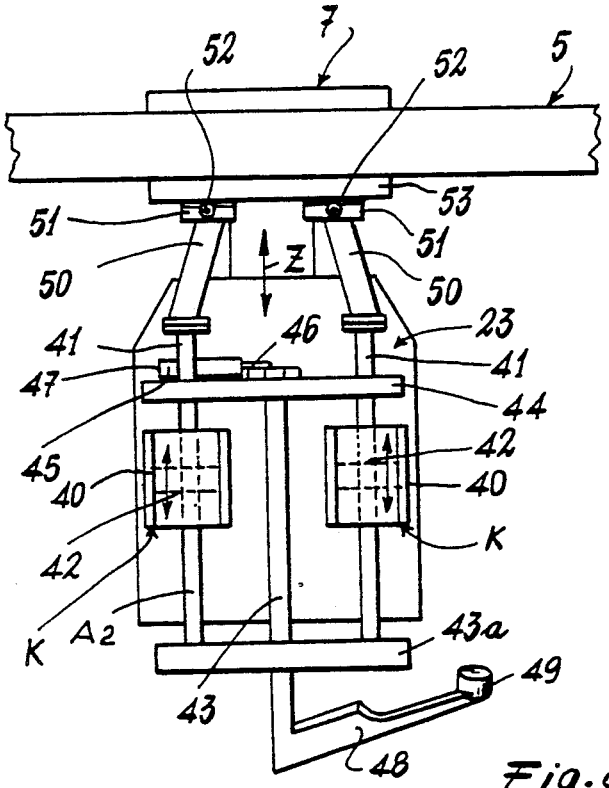
FIG. 8 is a schematic view (with some parts removed) taken in the direction of the arrow VIII of FIG. 6.
Figure 9:
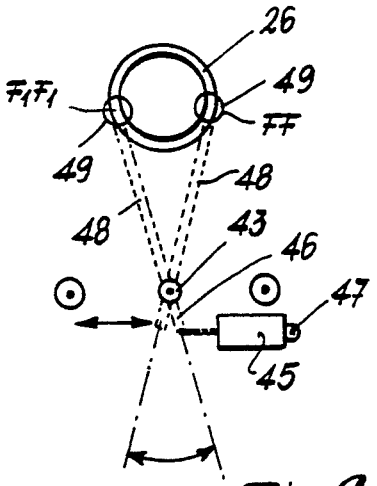
FIG. 9 is a schematic plan view showing the position of the bevelling tool and the two alternative positions which a support wheel for the sheet can assume.

In FIGS. 4 to 16, the reference numeral 1 indicates the apparatus overall. It comprises a bed 2, four corner uprights 3 connected together at their top, two parallel guides 4 supported by pairs of uprights, a first slide 5 supported by the guides 4 such as to be able to move in the direction Y, two parallel guides 6 supported by said first slide 5, and a second slide 7 supported by the guides 6 such as to be able to move in the direction X perpendicular to said direction Y. Known drive means provide for movement in the two stated directions. These means can consist of rack, circulating ball or chain transmission, as indicated in FIG. 5 by R1 and S1 and operated by motor means, of which only the means M mounted on the first slide 5 is visible, its purpose being to operate the transmission S1 which moves the slide 7 in the direction X.

The slide 7 supports an operating head 8 in such a manner as to enable it to:

a) rotate about a vertical axis Z perpendicular to the said directions X and Y, and b) move vertically, i.e. in the direction Z.

Figure 12:
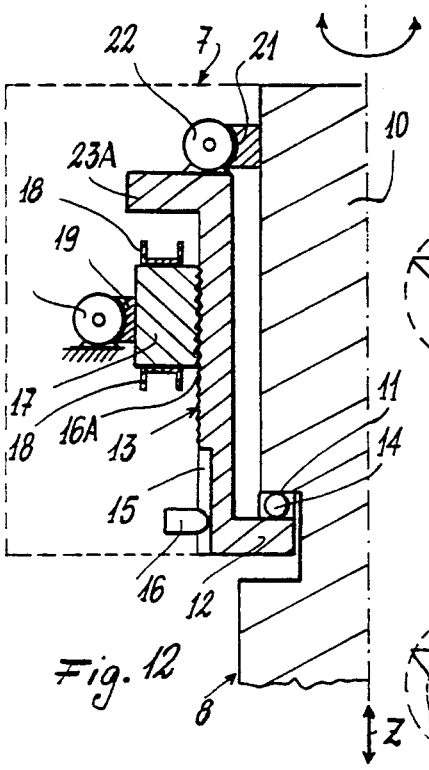
FIG. 12 is a schematic longitudinal half-section showing the means for rotating and vertically moving the operating head.

These movements can be obtained in any suitable known manner. One possible method is shown in FIG. 12, in which it can be seen that the head 8 possesses a central pivot 10 and a circular shoulder 11 by which it rests on the inner flange 12 of a sleeve 13 via a thrust bearing 14. The sleeve 13 comprises an external longitudinal groove 15 into which a projection 16 penetrates to prevent rotation of the sleeve but not its axial movement. The projection is rigid with the structure of the slide 7. The sleeve 13 is threaded at 16A. With this thread there engages a nut screw 17 which is rotatably supported but axially fixed in supports 18 of the slide 7. The nut screw 17 is associated with a helical gear 19 engaged with a worm 20 driven by a reversible motor, not shown, supported in the slide 7. Rotation of the nut screw 13 therefore results in movement of the head 8 in the direction Z. With the pivot 10 there is rigid a helical gear 21 engaged with a worm 22 driven by reversible motor means, not shown, supported by an upper external flange 23A of the sleeve 13. These motor means therefore rotate the head 8 about the Z axis.

At the lower end of its pivot 13 (see FIGS. 6 and 7), the head 8 comprises a member 23 of inverted U-shape. Two prismatic guides 24, 25 of circular arc shape are rigid with the parallel arms of said body 23 at different heights thereof such that the centre of curvature of the arcs falls on the same frontal diameter A of a bevelling tool 26 when this has its axis vertical. In this example the tool is shown as a cup grinding wheel.

Figure 11:
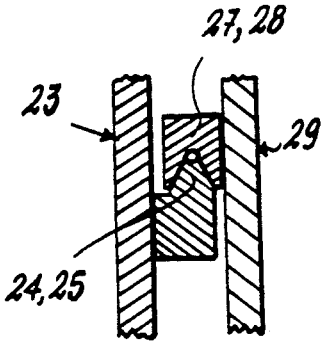
FIG. 11 is a section through the curved guides taken on the line XI—XI of FIG. 10.

On the guides 24, 25 there rest complementary prismatic guides 27, 28 which are rigid at their exterior with the parallel sides of a second U-shaped member 29 internal to and supported by the first. FIG. 11 is a detailed section showing the prismatic guides and their method of cooperation.

The inner member is therefore supported by the outer member 23 to rotate about the diameter A when the tool axis is vertical. Travel stops, not shown, fixed to the ends of the guides 24, 25, which extend through a greater angle than the cooperating guides, limit the angular movement of the inner member 29.

On the end wall 29A of the member 29 there are provided two prismatic circular arc-shaped guides 30, 31 analogous to the guides 24, 25 shown in FIG. 11, to which reference should therefore be made for further details. The centre of curvature of the guides 30, 31 falls on a diametrical axis B of the bevelling tool 26. The axis B is perpendicular to the aforesaid axis A. With the prismatic guides 30, 31 there cooperate corresponding prismatic circular arc-shaped guides 32, 33 (analogous to the guides 27, 28—see also FIG. 11) rigid with a plate 34 which supports a conventional rotary assembly 35 carrying the tool 26. The assembly comprises in known manner an electric motor which drives the spindle 35*a* to which the tool 26 is removably fixed. The spindle 35*a* can be micrometrically and manually moved in the longitudinal direction by a knob 35*b* or a motor control, not shown. The assembly 35 is advantageously carried by the plate 34 in such a manner that its axial position can be adjusted. This can be achieved for example by placing the assembly 35 on a slide mounted slidingly in a guide of for example dovetail shape provided in the plate 34.

This slide can be driven by a conventional manually operated lead screw and nut assembly.

Figure 10:
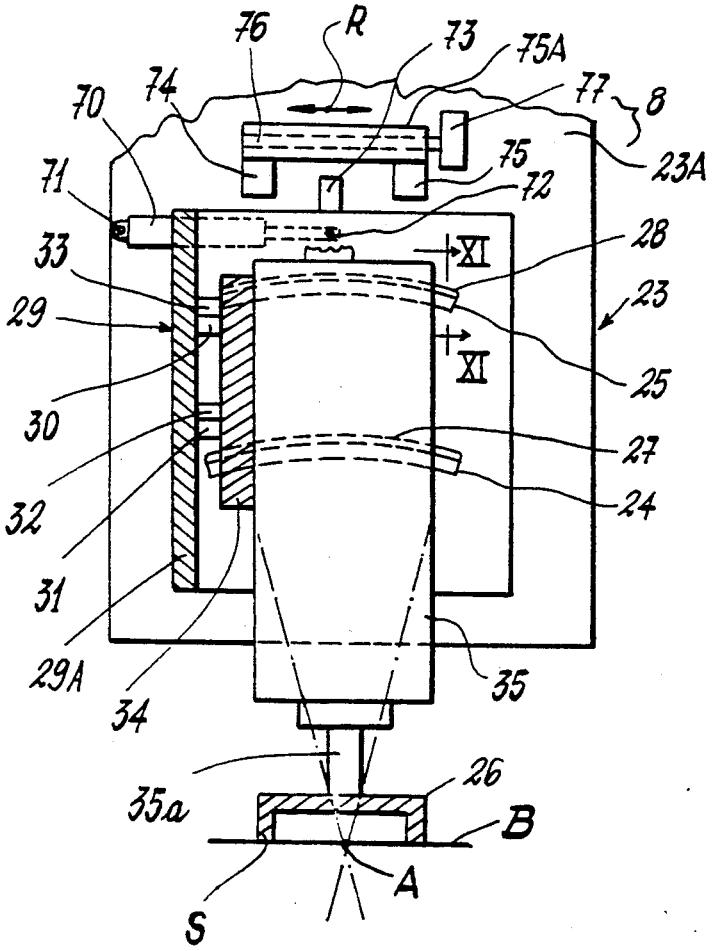
FIG. 10 is a view corresponding to that of FIG. 7 showing the means for adjusting the rake angle of the bevelling tool.

To move the inner member 29 angularly within the outer member 23 the device shown in FIG. 10 can be used. This angular movement sets the rake angle of the tool 26.

Figure 16:
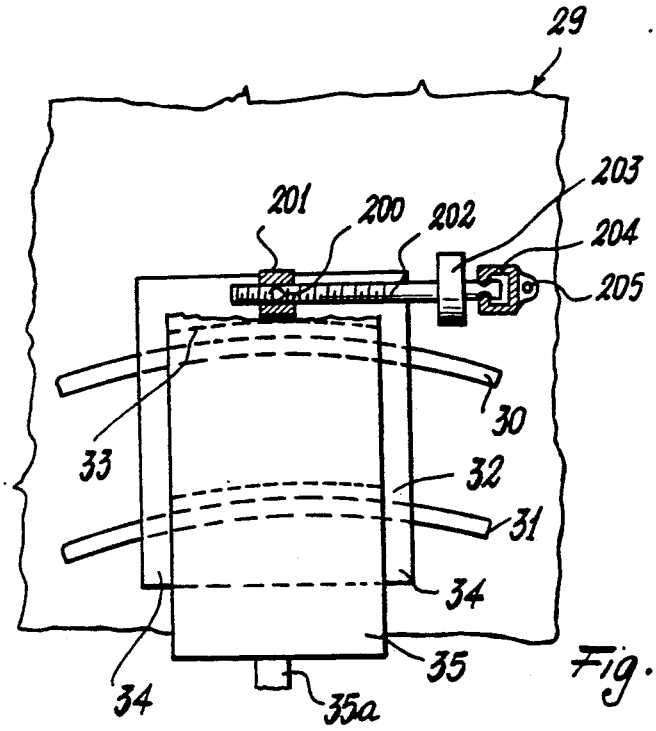
FIG. 16 is a front view of the means for adjusting the bevel angle.

The device in question comprises a double-acting pneumatic actuator 70, the cylinder of which is pivoted at 71 to the outer member 23, whereas its rod is pivoted to the inner member 29 as indicated at 72. The device also comprises a finger or projection 73 on the inner member 23. Under the action of the actuator 70 the finger 73 can be brought into and kept in contact with one or other of the adjustable stops 74, 75. These stops are mounted slidable (in the direction R) in a guide 75A, for example with dovetail engagement. The guide 75 is fixed to the wall 23*a* of the member 23. A worm 76 threaded half in one direction and half in the other engages in correspondingly threaded holes provided at the base of the stops. A knob 77 is used to rotate the worm 76 to cause the stops to approach or withdraw from each other. To move the assembly 35 relative to the inner member 29 in order to adjust the bevel angle, the mechanism of FIG. 16 is used. A nut screw 201 is pivoted at 200 to the plate 34, for example. A screw 202 rigid with a knob or handwheel 203 engages the nut screw. At its end distant from the nut screw 201, the screw 202 is mounted, rotatably but axially fixed, in a support 204 which is pivoted at 205 to the inner member 29. On rotating the screw 202 the assembly 35 moves along the circular guides 30, 31 via its contact guides 23, 33.

On the outside of one of the sides of the outer member 23 there are fixed two pneumatic cylinders 40.

Each cylinder is traversed by a rod 41. The rods are connected to a piston 42 disposed in the relative cylinder. The rods are connected together by two plates 43*a*, 44. The two plates rotatably support a rod 43. The rod 43 is rotated into two end positions by a double-acting pneumatic actuator cylinder 45 acting on a lever 46 fixed to the upper end of the rod. The cylinder 45 is pivoted at 47 to the upper plate 44. The rod 43 carries at its bottom a bracket 48 which at its free end supports an idle roller 49 inclined to the vertical.

At their upper ends the rods 41 are rigid with inclined extensions 50. The upper ends of these extensions are rigid with supports 51 which carry rollers 52 bearing against the lower face of a plate 53 (forming part of the slide 7) when pressurized air is fed into the cylinders 40 below the pistons 42 as indicated by the arrows K.

As is apparent, the purpose of the roller 49 is to position itself below the sheet L (see for example FIG. 6) where the bevelling tool 26 acts, to provide support for the sheet during the operation.

It should be noted that because of the described special construction, the roller remains adhering to the lower side of the sheet without following the movements of the bevelling tool 26 (or head 8) along the Z axis. In this respect, if the tool 26 moves downwards (or upwards) relative to the sheet, the bearing roller 49 remains in its position, i.e. in contact with the sheet. This is because the connection between the roller 49 and head 8 is by an air cushion between the lower face 42A of the pistons 42 and the lower wall 40A of the cylinders 40, this air cushion acting upwards on the pistons 42 (even when the head 8 rises or descends) to maintain the rollers 52 in contact with the plate 53 and thus keep the roller 49 in the required position.

Before the bevelling tool 26 acts on the sheet, the pressure in the cylinders 40 is reduced to a level which allows the roller 49 to separate from the sheet. The pressure in the cylinders 40 is then increased to apply the roller 49 to the sheet.

Before commencing the machining, the sheet L is rested on the substantially flat upper face of a support 60 which extends upwards from the apparatus bed 1. The support is connected to a vacuum source (not shown) via ducts 61 which open into the upper face of the support 60 so that the sheet L can be securely retained on said face. As is apparent this face has a smaller area than the sheet L so that that edge of this latter to be bevelled projects freely beyond said face, as shown in FIG. 4. The various movements to be undergone by the described apparatus are controlled by a numerical control processor in accordance with a predetermined program, after feeding-in the data relative for example to the shape of the sheet contour, its thickness etc. The sheet L is rested and clamped on the support 60 (see FIGS. 6 and 4).

The mobile stops (74, 75) are adjusted to set the rake angle of the tool and thus the angular position of the inner member 29 relative to the outer member 23, this position being fixed by operating the actuator 70. The angular position of the assembly 35 relative to the inner member, corresponding to the required bevel angle, is set by the screw 202 which operates the nut screw 201 located on the plate 34 carrying the assembly 35.

Figure 15:
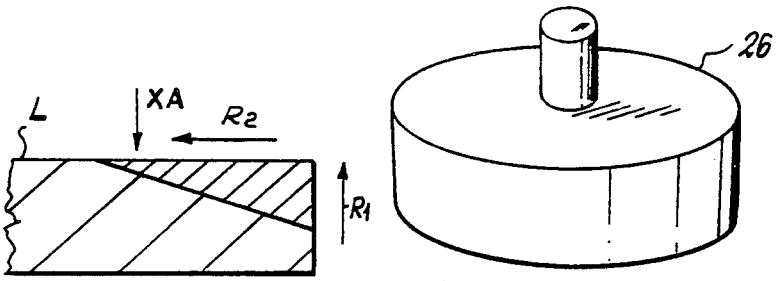
FIG. 15 is a schematic view of the bevelling tool and sheet, this latter being shown in section at the vertex of the interior angle.

The effect of these two angular movements is to make the bevelling tool 26 pass for example from a position in which it was parallel to a horizontal plane (X, Y) to a skew position in which the angle between one of its diameters and its projection on said plane is equal to the bevel angle to be obtained, and the angle between a diameter perpendicular to the preceding and its projection on said plane is equal to the rake angle. Relative to the sheet L (which can be considered the X-Y plane) the tool 26 lies as shown in FIG. 15.

Figure 13:
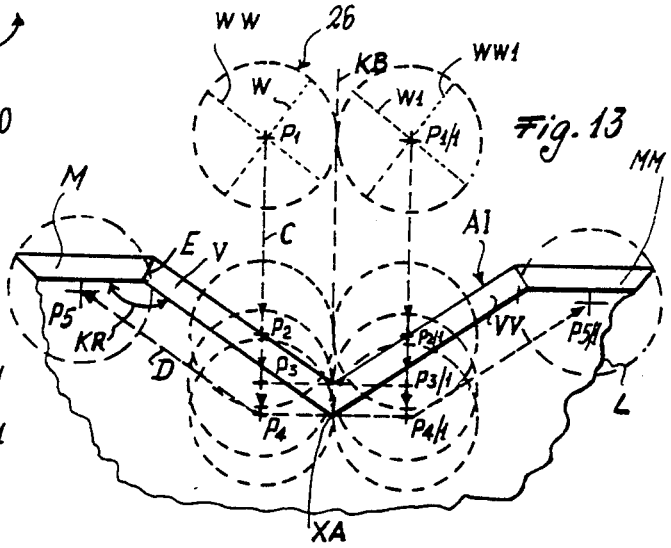
FIG. 13 is a schematic plan view showing the path of the bevelling tool when bevelling an interior angle of a partly shown sheet.

The sheet L (FIG. 13) to be bevelled has an interior angle AI. The bisector of this angle is indicated by KB. In FIG. 13, which is a plan view, the bevelling tool 26 is represented by a dashed-line circle for simplicity, whereas it should correctly have been represented by an ellipse. The circle represents the contour of the lower face S (see FIGS. 4, 7) of the tool 26. The lower face S represents the active side of the tool (such as a cup grinding wheel).

To bevel the interior angle AI the rotary tool 26 is positioned in the position P1 with the lower contour of its lower face S tangential to the bisector KB. While remaining tangential to the bisector the tool is moved in the direction of the arrows C, and thus parallel to the bisector KB. The reaction roller 49 passes below the sheet L to support it at the point where the tool 26 acts (FIG. 9), for example at FF.

As already stated, said roller can undergo limited vertical movement under the control of the cylinders 40, to enable it to pass under the sheet without touching its lower sharp edge, which would result in rapid wear of the roller.

The tool 26 on coming into contact with the sheet undergoes the trajectory shown in FIG. 15, this trajectory comprising a vertical component R1) along the Z axis) and a horizontal component R2 in the X-Y plane, to remove that part of triangular section shown in denser hatching. When the tool 26 has removed this it is located in the position P4. At this point it is moved parallel to itself in the direction of the arrow D, this direction being parallel to the side V of the interior angle AI. During this movement the bevel is created on this side. Then having reached the position P5, i.e. the vertex of the exterior angle KR it is moved (by rotating the head 8 about the Z axis) to bevel the adjacent side M.

It should be noted that in the described machining of the side V and vertex XA of the interior angle, the bevel angle is set on that diameter W which is perpendicular to the side V, whereas the rake angle is set on the diameter WW perpendicular to W. The bevelling of the contour of the sheet L proceeds until the tool 26 reaches the end of the side MM. From this position it return to the position P1/1 to be again tangential to the bisector KB but on the opposite side of it. During this passage the head 8 rotates (about the Z axis) so that the diameters W and WW of the tool 26 pass into the position W1 and WW1 respectively. The support roller 49 passes to the position F1F1. The tool then moves into the positions P2/1, P3/1 and P4/1 while remaining tangential to the bisector KB, to thus bevel the other side of the vertex XA by an analogous procedure to that already described in relation to the movement beginning from P1. The tool 26 then moves parallel to itself to bevel the side VV of the interior angle AI and move to P5/1.

An identical result is obtained if the entire interior angle AI is bevelled before bevelling outside this angle. In this case the sequence of movements is P1→P2→P3→P4→P5→P1/1→P2/1→P3/1→P4/1→P5/1.

Figure 14:
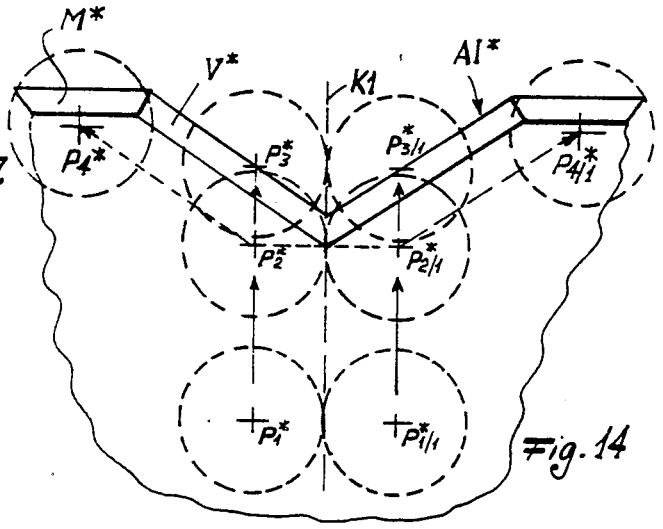
FIG. 14 is a view analogous to that of FIG. 13 showing a different path of the bevelling tool.

In the modification of FIG. 14, the tool 26 starts from **P*1; when it reaches P*2 it descends progressively until P*3 while always keeping the contour of its active part S parallel to the bisector KB1 and tangential to it. It then moves parallel to itself along the side V of the interior angle AI* to reach P*4. From P*4 it can continue to bevel by proceeding along the side M* to reach P*4/1, and then move to P*1/1, P*2/1, P*3/1 and again to P*4/1, or alternatively from P*4 it can move to P*1/1 and then in succession to P*2/1, P*3/1 and P*4/1**.

If because of the amount of sheet to be removed the bevelling requires more than one passage, the operation is repeated the necessary number of times but always using the same method at the inner vertex. Again, as bevelling is known to generally require the successive use of different rotary tools (first grinding wheels and then buffers), the method of the invention is used for all these different tools in the machining and finishing of the interior angle.

What I claim is:

1. A method for bevelling interior angles of sheets of coloured or non-coloured plain glass, plate glass or flattened glass using a rotary tool, characterized in that the vertex of the interior angles is bevelled, with assigned rake and bevel angles of the tool which rotates about its own axis, by moving the tool parallel to the bisector of said angle, first on one side and then on the other side of the bisector, with the outermost part of the active portion of the tool substantially tangential to said bisector during the movement of the tool on said one side and said other side of said bisector.

2. A method as claimed in claim 1, characterized in that in moving parallel to the bisector the tool commences at a point which is within said interior angle.

3. A method as claimed in claim 1, characterized in that in moving parallel to the bisector the tool commences at a point which is within the contour of the sheet.

4. A method as claimed in claim 1, characterized in that in moving parallel to the bisector the tool operating on the sheet has a vertical movement component which is perpendicular to the plane of the sheet.

5. A method as claimed in claim 1, characterised in that the sheet is stationary.

6. A method as claimed in claim 1, characterised in that the sheet is supported substantially horizontal.

7. A method as claimed in claim 1, wherein the tool is mobile in three mutually perpendicular directions.

* * * * *